US011778369B2

(12) United States Patent
Kobayashi

(10) Patent No.: US 11,778,369 B2
(45) Date of Patent: Oct. 3, 2023

(54) NOTIFICATION APPARATUS, NOTIFICATION METHOD, AND PROGRAM

(71) Applicant: NIPPON TELEGRAPH AND TELEPHONE CORPORATION, Tokyo (JP)

(72) Inventor: Kazunori Kobayashi, Tokyo (JP)

(73) Assignee: NIPPON TELEGRAPH AND TELEPHONE CORPORATION, Tokyo (JP)

( * ) Notice: Subject to any disclaimer, the term of this patent is extended or adjusted under 35 U.S.C. 154(b) by 0 days.

(21) Appl. No.: 17/612,205

(22) PCT Filed: May 21, 2019

(86) PCT No.: PCT/JP2019/020085
§ 371 (c)(1),
(2) Date: Nov. 17, 2021

(87) PCT Pub. No.: WO2020/234993
PCT Pub. Date: Nov. 26, 2020

(65) Prior Publication Data

US 2022/0225019 A1 Jul. 14, 2022

(51) Int. Cl.
*H04R 1/40* (2006.01)

(52) U.S. Cl.
CPC ..... *H04R 1/40* (2013.01); *H04R 2499/13* (2013.01)

(58) Field of Classification Search
CPC ..... H04R 1/40; H04R 2499/13
See application file for complete search history.

(56) References Cited

U.S. PATENT DOCUMENTS 6,097,285 A * 8/2000 Curtin ..... B60Q 5/005 340/384.1
7,649,444 B1 * 1/2010 Fear ..... B60Q 5/00 340/384.1

(Continued)

FOREIGN PATENT DOCUMENTS

JP 4-259879 A 9/1992
JP 07159190 A 6/1995

(Continued)

OTHER PUBLICATIONS

Yamaha Corporation, "WO2017056707—Obstacle Notification Device and Obstacle Notification Method", Apr. 6, 2017, patentscope.wipo.int, WIPO Translate Japanese to English Machine Translation, pp. 1-20. (Year: 2017).*

(Continued)

*Primary Examiner* — Daniel R Sellers

(57) ABSTRACT

Provided is a notification technique that makes it possible to notify a person of a direction in which a danger exists, using a sound. A notification apparatus includes: an audio signal determination unit that determines, from information (hereinafter referred to as type information) regarding a type of a danger estimated based on sensor data that is data acquired by a sensor, an audio signal corresponding to a type indicated by the type information; an audio image forming unit that determines, from the audio signal and information (hereinafter referred to as direction information) regarding a direction in which the danger has occurred estimated based on the sensor data, audio image information that are combinations of a speaker that is to emit a sound to prompt a driver to pay attention to the direction indicated by the direction information and an audio signal that is to be played back by the speaker, by performing beam forming; and speakers that play back an audio signal input thereto, wherein the audio image information is determined based on (Continued)

a positional relationship between the speakers, a structural object of a vehicle, and the driver so that the driver perceives a sound emitted from the speakers and reflected by the structural object of the vehicle as a sound coming from the direction indicated by the direction information.

8 Claims, 8 Drawing Sheets

(56) References Cited

U.S. PATENT DOCUMENTS

| | | | | |
|---|---|---|---|---|
| 2005/0280519 | A1 | 12/2005 | Nagata | |
| 2014/0167967 | A1* | 6/2014 | He | B60W 50/16 340/576 |
| 2018/0033307 | A1* | 2/2018 | Tayama | G08G 1/16 |
| 2018/0132052 | A1* | 5/2018 | Muench | H04R 3/005 |
| 2018/0186286 | A1* | 7/2018 | Groh | H04S 7/302 |
| 2020/0285870 | A1* | 9/2020 | Yi | B60W 50/14 |

FOREIGN PATENT DOCUMENTS

| | | | |
|---|---|---|---|
| JP | 2004271983 | A | 9/2004 |
| JP | 2006005868 | A | 1/2006 |
| JP | 2008143381 | A | 6/2008 |
| JP | 2013-173430 | A | 9/2013 |
| JP | 2017-068641 | A | 4/2017 |
| KR | 20180090644 | A | 8/2018 |
| WO | WO-2017056707 | A1 * | 4/2017 |

OTHER PUBLICATIONS

Toyota Prius PHV safe performance, [online], [searched on Apr. 17, 2019], the Internet <URL: https://toyota.jp/priusphv/safety/support/> with translation generated by machine.

* cited by examiner

NOTIFICATION APPARATUS, NOTIFICATION METHOD, AND PROGRAM

CROSS-REFERENCE TO RELATED APPLICATIONS

This application is a U.S. National Stage Application filed under 35 U.S.C. § 371 claiming priority to International Patent Application No. PCT/JP2019/020085, filed on 21 May 2019, the disclosure of which is hereby incorporated herein by reference in its entirety.

TECHNICAL FIELD

The present invention relates to a technique for emitting a warning sound from a vehicle.

BACKGROUND ART

Currently, automobiles that are equipped with various sensors to avoid a collision are on the market. In such an automobile, when a danger is detected by a sensor, a warning sound is emitted from a speaker to prompt the driver to perform an operation to avoid the danger. What is important in such a case is to make the driver immediately discern the type of the danger and the direction in which the danger exists, and make the driver quickly perform an operation to avoid the danger.

According to a conventional technique, only the type of the danger is notified by using a warning sound, and the direction in which the danger exists is separately notified by using an image (see NPL 1).

CITATION LIST

Non Patent Literature

[NPL 1] TOYOTA PRIUS PHV safe performance, [online], [searched on Apr. 17, 2019], the Internet <URL: https://toyota.jp/priusphv/safety/support/>

SUMMARY OF THE INVENTION

Technical Problem

Such an image enables the driver to discern the direction in which the danger exists, but the driver cannot determine the location of the danger until they look at the image. Therefore, there is a problem in that the driver takes a long time to make a decision and will be late in starting an operation to avoid the danger.

Therefore, the present invention aims to provide a notification technique that makes it possible to notify the driver of the direction in which a danger exists, using a sound.

Means for Solving the Problem

One aspect of the present invention is a notification apparatus including: an audio signal determination unit that determines, from information (hereinafter referred to as type information) regarding a type of a danger estimated based on sensor data that is data acquired by a sensor, an audio signal corresponding to a type indicated by the type information; an audio image forming unit that determines, from the audio signal and information (hereinafter referred to as direction information) regarding a direction in which the danger has occurred estimated based on the sensor data, audio image information that are combinations of a speaker that is to emit a sound to prompt a driver to pay attention to the direction indicated by the direction information and an audio signal that is to be played back by the speaker, by performing beam forming; and speakers that play back an audio signal input thereto, wherein the audio image information is determined based on a positional relationship between the speakers, a structural object of a vehicle, and the driver so that the driver perceives a sound emitted from the speakers and reflected by the structural object of the vehicle as a sound coming from the direction indicated by the direction information.

One aspect of the present invention is a notification apparatus including: an audio signal determination unit that determines, from information (hereinafter referred to as type information) regarding a type of a danger estimated based on sensor data that is data acquired by a sensor, an audio signal corresponding to a type indicated by the type information; a fluctuation adding unit that generates, from information (hereinafter referred to as direction information) regarding a direction in which the danger has occurred estimated based on the sensor data, new direction information by adding directional fluctuations to the direction information; an audio image forming unit that determines, from the audio signal and the direction information, audio image information that are combinations of a speaker that is to emit a sound to prompt a driver to pay attention to the direction indicated by the direction information and an audio signal that is to be played back by the speaker, by performing beam forming; and speakers that play back an audio signal input thereto, wherein the audio image information is determined based on a positional relationship between the speakers and the driver so that the driver perceives a sound emitted from the speakers as a sound coming from the direction indicated by the direction information.

One aspect of the present invention is a notification apparatus including: an audio signal determination unit that determines, from information (hereinafter referred to as type information) regarding a type of a danger estimated based on sensor data that is data acquired by a sensor, an audio signal corresponding to a type indicated by the type information; a fluctuation adding unit that generates, from information (hereinafter referred to as direction information) regarding a direction in which the danger has occurred estimated based on the sensor data, new direction information by adding directional fluctuations to the direction information; an audio image forming unit that determines, from the audio signal and the direction information, audio image information that are combinations of a speaker that is to emit a sound to prompt a driver to pay attention to the direction indicated by the direction information and an audio signal that is to be played back by the speaker, by performing pan control; and speakers that play back an audio signal input thereto.

Effects of the Invention

According to the present invention, a driver can discern the direction in which a danger exists by hearing a sound.

DESCRIPTION OF EMBODIMENTS

The following describes embodiments of the present invention in detail. Note that components that have the same functions are given the same numbers and duplicative descriptions are omitted.

First Embodiment

A notification apparatus emits an alert sound to a driver to notify the driver of the type of the danger and the direction in which the danger exits, based on information regarding the type of the danger (hereinafter referred to as type information) and information regarding the direction in which the danger has occurred (hereinafter referred to as direction information), which are estimated based on sensor data that is data acquired by a sensor.

Figure 1:
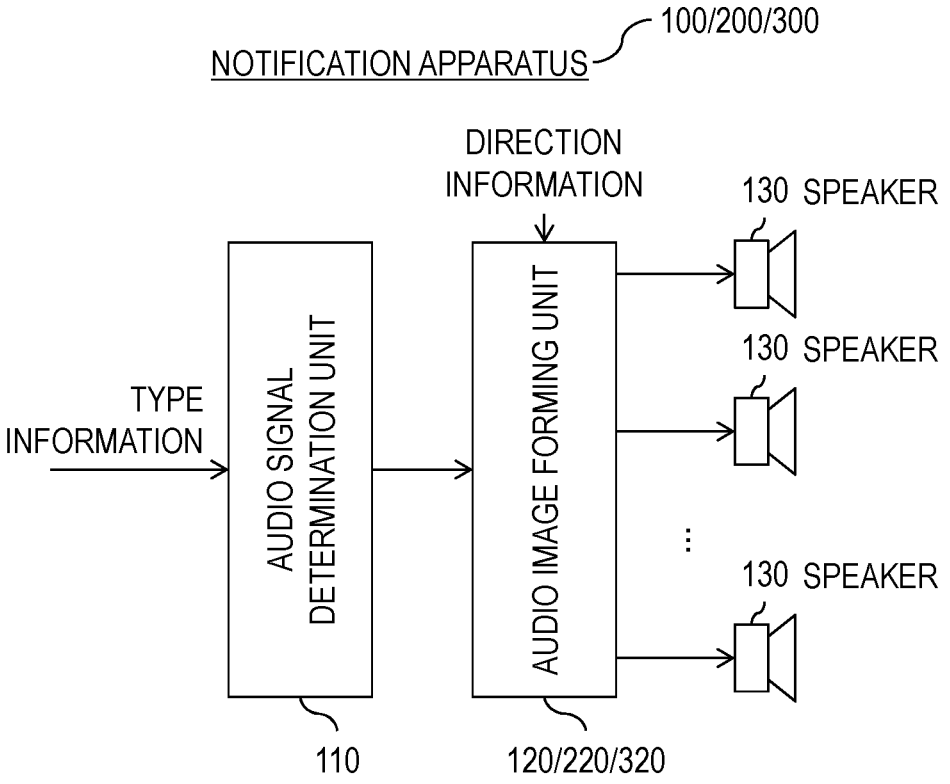
FIG. 1 is a block diagram showing an example of a configuration of a notification apparatus 100/200/300.
Figure 2:
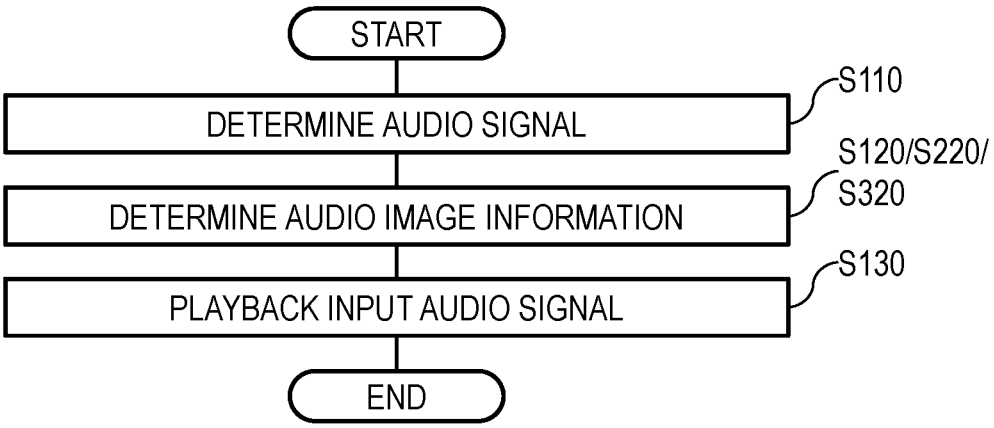
FIG. 2 is a flowchart showing examples of operations of the notification apparatus 100/200/300.

The following describes a notification apparatus 100 with reference to FIGS. 1 and 2. FIG. 1 is a block diagram showing a configuration of the notification apparatus 100. FIG. 2 is a flowchart showing operations of the notification apparatus 100. As shown in FIG. 1, the notification apparatus 100 includes an audio signal determination unit 110, an audio image forming unit 120, and speakers 130. Here, the notification apparatus 100 includes N speakers 130 (N is an integer equal to or greater than 2). The speakers 130 are components that play back an input audio signal to emit a sound.

The following describes operations of the notification apparatus 100 with reference to FIG. 2.

In S110, the audio signal determination unit 110 receives type information as an input, and determines and outputs an audio signal corresponding to the type indicated by the type information. For example, the notification apparatus 100 may record a correspondence table indicating a correspondence relationship between pieces of type information and audio signals in a recording unit (not shown) in advance, and the audio signal determination unit 110 may determine an audio signal from the type information by using the correspondence table.

In S120, the audio image forming unit 120 receives the audio signal determined in S110 and direction information as inputs, selects, using the direction information, a speaker (hereinafter referred to as a playback speaker) that is to emit a sound to prompt the driver to pay attention to the direction indicated by the direction information and generates an audio signal that is to be played back by the playback speaker (hereinafter referred to as a playback audio signal) from the audio signal to determine audio image information that is a combination of a playback speaker and a playback audio signal, and outputs a playback audio signal specified in the audio image information to the speaker 130 specified in the audio image information. That is to say, the audio image forming unit 120 changes the position of the audio image according to the direction in which the danger has occurred. Here, an audio image is the location of a sound, perceived by the driver when the driver hears the sound. For example, based on direction information, the audio image forming unit 120 may determine the speaker 130 that is closest to the direction indicated by the direction information, as a playback speaker.

In S130, the speaker 130 specified in the audio image information determined in S120 plays back the playback audio signal specified in the audio image information.

Although control of an audio image position performed to alert the driver is described above, control of an audio image position may be performed to alert a passenger, or performed to alert both the driver and the passenger.

Also, a danger of which the driver and/or the passenger are/is to be notified may be a danger that has occurred in the vehicle. If this is the case, the position of the audio image may be controlled according to a relative positional relationship between the person to be notified, such as the driver or the passenger, and the position and direction of the danger that has occurred. For example, the position of the audio image may be controlled by executing posture estimation processing based on data that has been acquired by sensors, such as an image or a point cloud. Also, when the danger that the driver is dozing is detected based on an acoustic signal collected by a microphone installed in the vehicle, the position of the audio image may be controlled so that a sound that is based on an audio signal that corresponds to the type that indicates dozing can be perceived by the passenger, from the position or the direction of the driver relative to the passenger that is to be notified.

With the embodiment according to the present invention, a driver can discern the direction in which a danger exists by hearing a sound. By selecting a speaker according to the direction in which a danger exits, and emitting a sound, it is possible to enable the driver to instantly discern the direction. That is to say, the driver is enabled to immediately perform an operation to avoid the danger without checking the screen.

Second Embodiment

The notification apparatus 100 controls an audio image by selecting a playback speaker. Therefore, the audio image can only be formed at a position where a speaker is provided. Therefore, a notification apparatus 200 makes it possible to localize an audio image at a position where a speaker is not provided, by causing a plurality of speakers to play back an audio signal based on a proportion that has been calculated in advance (perform pan control), according to direction information. For example, by performing pan control so that two speakers emit a sound at the same time, it is possible to localize an audio image between the two speakers.

The following describes the notification apparatus 200 with reference to FIGS. 1 and 2. FIG. 1 is a block diagram showing a configuration of the notification apparatus 200. FIG. 2 is a flowchart showing operations of the notification apparatus 200. As shown in FIG. 1, the notification apparatus 200 includes the audio signal determination unit 110, an audio image forming unit 220, and the speakers 130. Here, the notification apparatus 200 includes N speakers 130 (N is an integer equal to or greater than 2). The notification apparatus 200 is different from the notification apparatus 100 only in that the audio image forming unit 220 is included instead of the audio image forming unit 120.

The following describes operations of the notification apparatus 200 with reference to FIG. 2.

In S110, the audio signal determination unit 110 receives type information as an input, and determines and outputs an audio signal corresponding to the type indicated by the type information.

In S220, the audio image forming unit 220 receives the audio signal determined in S110 and direction information as inputs, determines, by using the audio signal and the direction information and performing pan control, audio image information that are combinations of a speaker (hereinafter referred to as a playback speaker) that is to emit a sound to prompt the driver to pay attention to the direction indicated by the direction information and an audio signal (hereinafter referred to as a playback audio signal) to be played back by the speaker, and outputs the playback audio signals specified in the audio image information respectively to the speakers 130 specified in the audio image information.

Figure 3:
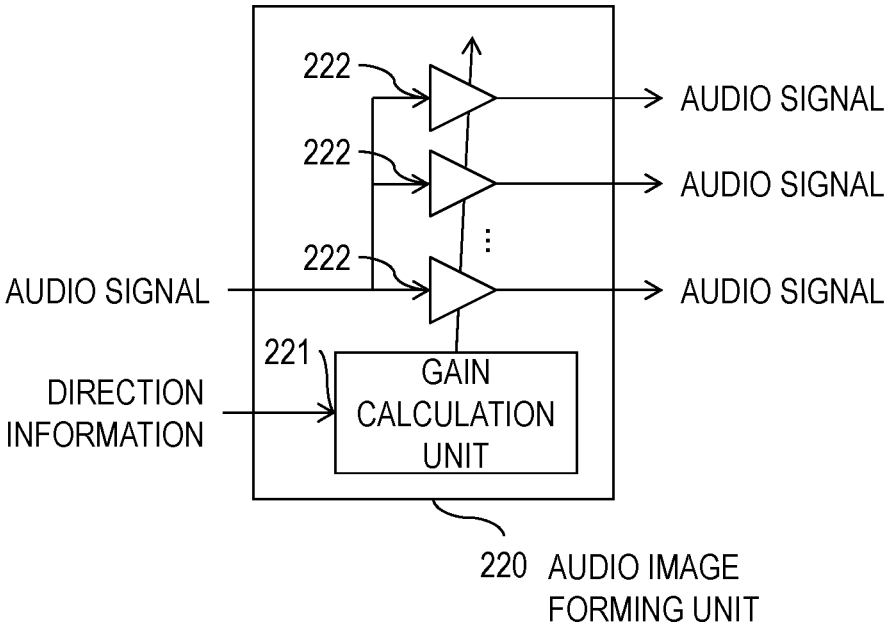
FIG. 3 is a block diagram showing an example of a configuration of an audio image forming unit 220.
Figure 4:
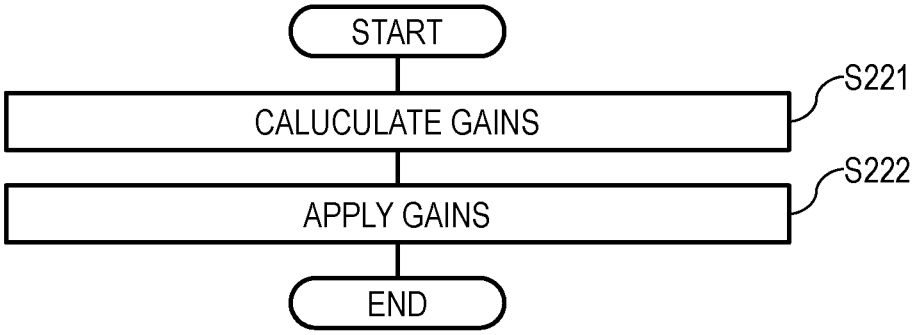
FIG. 4 is a flowchart showing examples of operations of the audio image forming unit 220.

The following describes an example of the audio image forming unit 220 with reference to FIGS. 3 and 4. FIG. 3 is a block diagram showing a configuration of the audio image forming unit 220. FIG. 4 is a flowchart showing operations of the audio image forming unit 220. As shown in FIG. 3, the audio image forming unit 220 includes a gain calculation unit 221 and multiplication units 222. Here, the audio image forming unit 220 includes N multiplication units 222. Note that N is the same as the number of speakers 130.

The following describes operations of the audio image forming unit 220 with reference to FIG. 4.

In S221, the gain calculation unit 221 receives direction information as an input, calculates gains that are to be used by the multiplication units 222 respectively corresponding to the N speakers 130 based on the direction information, and outputs the gains to the multiplication units 222 respectively corresponding to the speakers 130. For example, in order to localize an audio image at a desired position, the gain calculation unit 221 calculates gains corresponding to the desired localization position based on the relationship regarding the ratio between the position of the audio image and the playback volume at the time of stereo playback. Also, for example, the notification apparatus 200 may record a correspondence table indicating a relationship between an audio image localization position and a playback volume balance of the speakers in a recording unit (not shown) in advance, and the gain calculation unit 221 may calculate the gains by using the correspondence table.

In S222, each multiplication unit 222 receives an audio signal and the gain calculated in S221 as inputs, calculates a playback audio signal based on the audio signal and the gain, and outputs the playback audio signal to the speaker 130 corresponding to the multiplication unit 222.

In S130, each speaker 130 specified in the audio image information determined in S220 plays back the playback audio signal specified in the audio image information.

Also in the present embodiment, as in the first embodiment, control of an audio image position may be performed to alert a passenger, or performed to alert both the driver and the passenger. Also, as in the first embodiment, a danger of which the driver and/or the passenger are/is to be notified may be a danger that has occurred in the vehicle.

With the embodiment according to the present invention, a driver can discern the direction in which a danger exists by hearing a sound. By emitting a warning sound from a plurality of speakers in the proportion corresponding to the direction in which the danger exits, it is possible to localize an audio image at a position where a position is not provided, and enable the driver to more precisely discern the direction.

Third Embodiment

The notification apparatus 100 controls an audio image by selecting a playback speaker. Therefore, the audio image can only be formed at a position where a speaker is provided. Also, the notification apparatus 200 causes a plurality of speakers to play back an audio signal in the proportion that has been calculated in advance. Therefore, an audio image cannot be localized at a position that is not between speakers. Therefore, a notification apparatus 300 performs beam forming according to direction information so that an audio image can be localized at a position that is not between speakers. For example, by forming a beam (i.e. performing beam forming) so that the sound pressure is high at a position near the driver's right ear and the sound pressure is low at a position near the driver's left ear, using a plurality of speakers located in front of the driver who is the listener, it is possible to form an audio image on the right side of the driver.

The following describes the notification apparatus 300 with reference to FIGS. 1 and 2. FIG. 1 is a block diagram showing a configuration of the notification apparatus 300. FIG. 2 is a flowchart showing operations of the notification apparatus 300. As shown in FIG. 1, the notification apparatus 300 includes the audio signal determination unit 110, an audio image forming unit 320, and the speakers 130. Here, the notification apparatus 300 includes N speakers 130 (N is an integer equal to or greater than 2). The notification apparatus 300 is different from the notification apparatus 100 only in that the audio image forming unit 320 is included instead of the audio image forming unit 120.

The following describes operations of the notification apparatus 300 with reference to FIG. 2.

In S110, the audio signal determination unit 110 receives type information as an input, and determines and outputs an audio signal corresponding to the type indicated by the type information.

In S320, the audio image forming unit 320 receives the audio signal determined in S110 and direction information as inputs, determines, by using the audio signal and the direction information and performing beam forming, audio image information that are combinations of a speaker (hereinafter referred to as a playback speaker) that is to emit a sound to prompt the driver to pay attention to the direction indicated by the direction information and an audio signal (hereinafter referred to as a playback audio signal) to be played back by the speaker, and outputs the playback audio signals specified in the audio image information respectively to the speakers 130 specified in the audio image information.

The following describes two beam forming methods.

(Method 1) A Method Using Filters

This method uses the transmission characteristics of a sound from each speaker to the position where the sound pressure is desired to be high and the transmission characteristics of a sound from each speaker to the position where the sound pressure is desired to be low. According to this method, the filter coefficients of the filters corresponding to the speakers are calculated so that the sound pressure at the position where the sound pressure is desired to be high is as high as possible, and the sound pressure at the position where the sound pressure is desired to be low is as low as possible.

Figure 5:
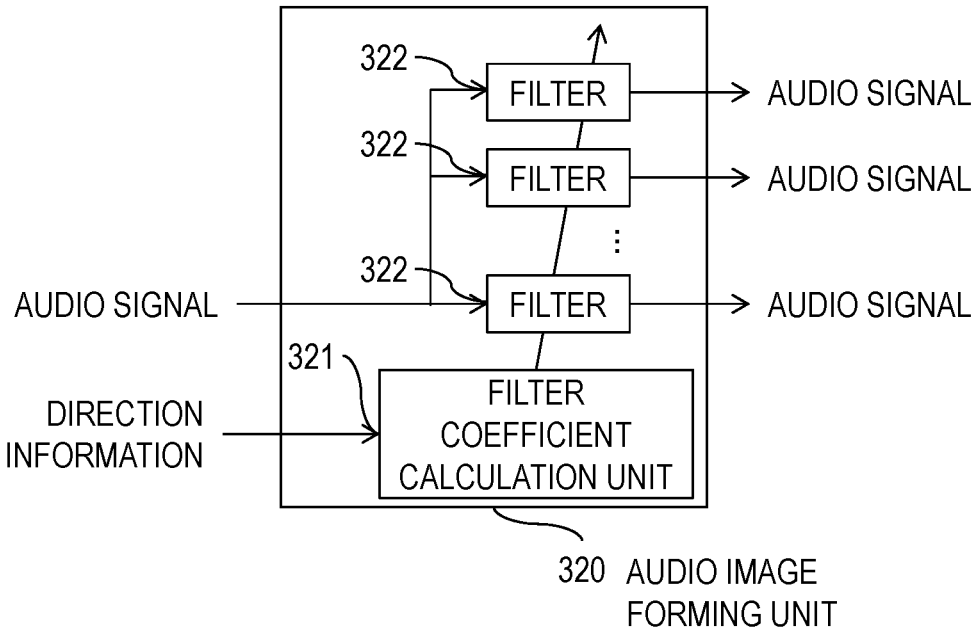
FIG. 5 is a block diagram showing an example of a configuration of an audio image forming unit 320.
Figure 6:
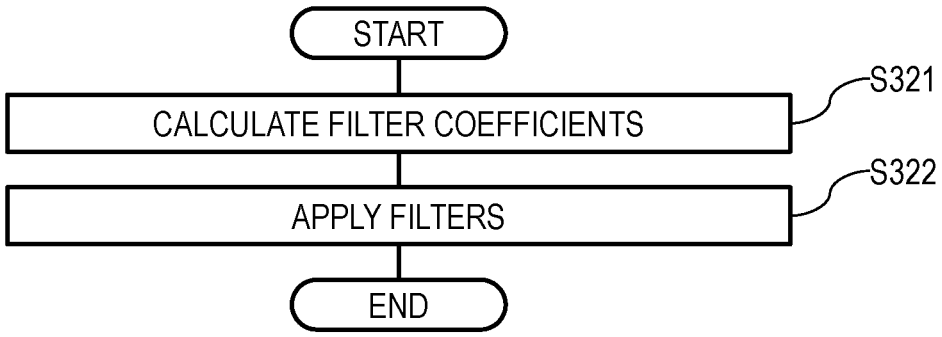
FIG. 6 is a flowchart showing examples of operations of the audio image forming unit 320.

The following describes an example of the audio image forming unit 320 with reference to FIGS. 5 and 6. FIG. 5 is a block diagram showing a configuration of the audio image forming unit 320. FIG. 6 is a flowchart showing operations of the audio image forming unit 320. As shown in FIG. 5, the audio image forming unit 320 includes a filter coefficient calculation unit 321 and filters 322. Here, the audio image forming unit 320 includes N filters 322. Note that N is the same as the number of speakers 130.

The following describes operations of the audio image forming unit 320 with reference to FIG. 6.

In S321, the filter coefficient calculation unit 321 receives direction information as an input, calculates filter coefficients that are to be used by the filters 322 respectively corresponding to the N speakers 130 based on the direction information, and outputs the filter coefficients to the filters 322 respectively corresponding to the speakers 130.

In S322, each filter 322 receives an audio signal and the filter coefficient calculated in S321 as inputs, calculates a playback audio signal based on the audio signal and the filter coefficient, and outputs the playback audio signal to the speaker 130 corresponding to the filter 322.

(Method 2) A Method Using Delays

According to this method, delay amounts that are to be given to an audio signal played back by the speakers are respectively calculated so that the delays at the position where the sound pressure is desired to be high are the same.

Figure 7:
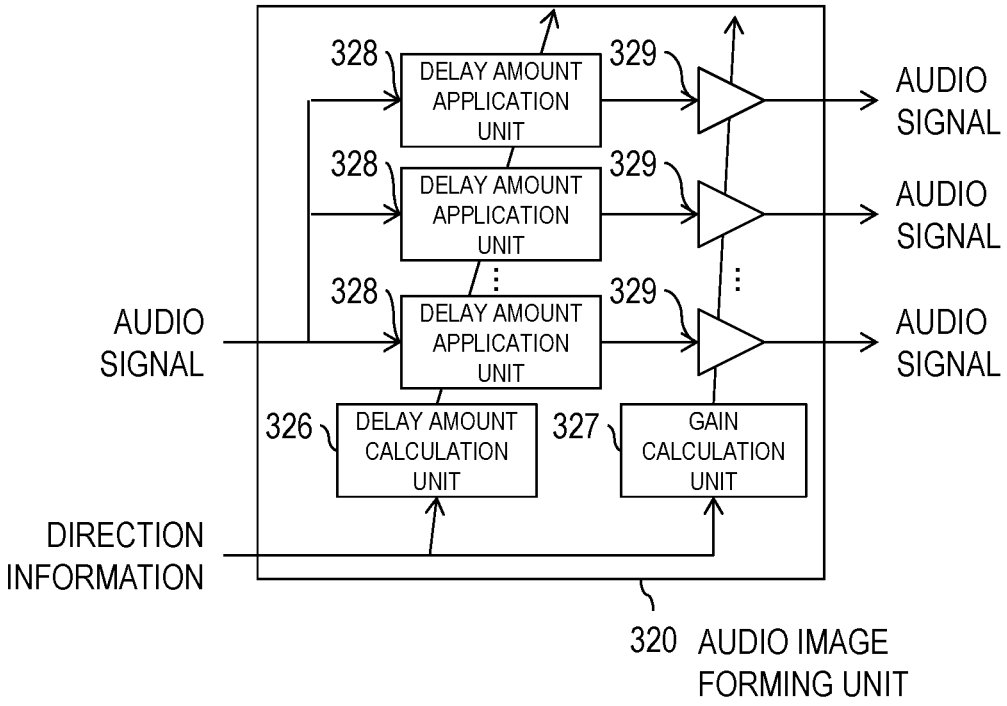
FIG. 7 is a block diagram showing an example of a configuration of the audio image forming unit 320.
Figure 8:
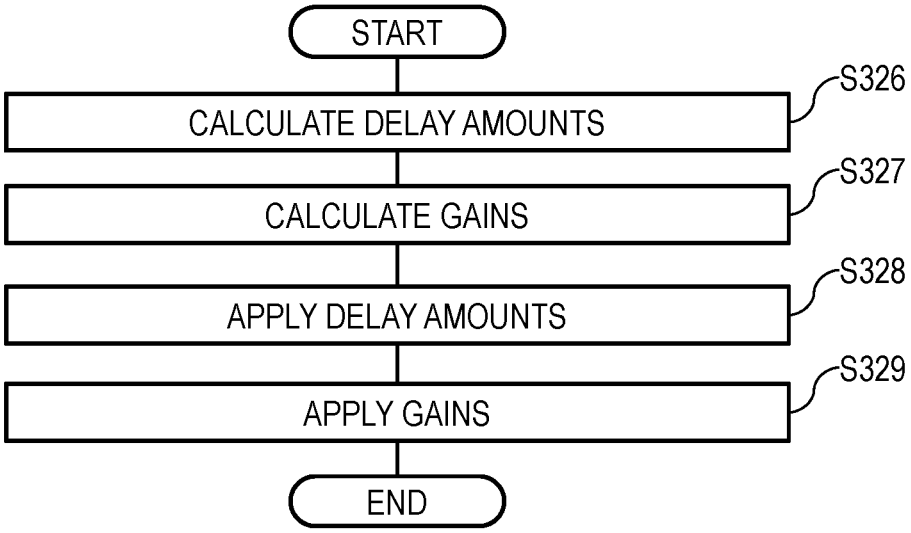
FIG. 8 is a flowchart showing examples of operations of the audio image forming unit 320.

The following describes an example of the audio image forming unit 320 with reference to FIGS. 7 and 8. FIG. 7 is a block diagram showing a configuration of the audio image forming unit 320. FIG. 8 is a flowchart showing operations of the audio image forming unit 320. As shown in FIG. 7, the audio image forming unit 320 includes a delay amount calculation unit 326, again calculation unit 327, delay amount application units 328, and multiplication units 329. Here, the audio image forming unit 320 includes N delay amount application units 328 and N multiplication units 329. Note that N is the same as the number of speakers 130.

The following describes operations of the audio image forming unit 320 with reference to FIG. 8.

In S326, the delay amount calculation unit 326 receives direction information as an input, calculates delay amounts that are to be used by the delay amount application units 328 respectively corresponding to the N speakers 130 based on the direction information, and outputs the delay amounts to the delay amount application units 328 respectively corresponding to the speakers 130.

In S327, the gain calculation unit 327 receives direction information as an input, calculates gains that are to be used by the multiplication units 329 respectively corresponding to the N speakers 130 based on the direction information, and outputs the gains to the multiplication units 329 respectively corresponding to the speakers 130.

Figure 9:
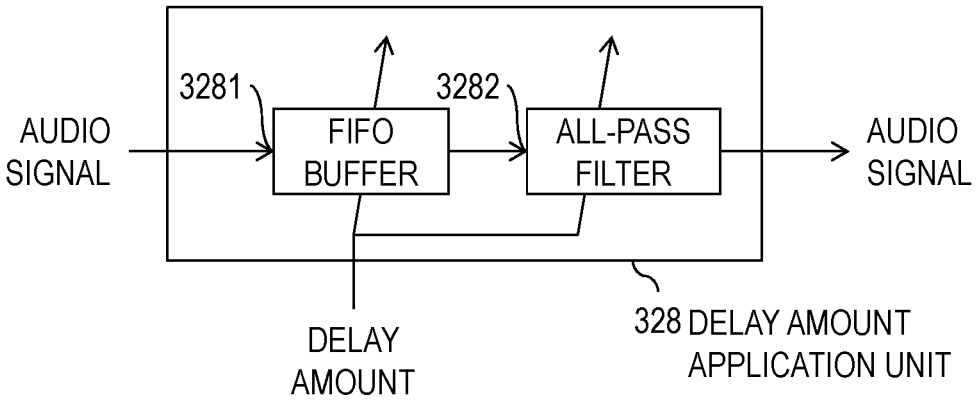
FIG. 9 is a block diagram showing an example of a configuration of a delay amount application unit 328.

In S328, the delay amount application units 328 respectively receive an audio signal and delay amounts calculated in S326. Thereafter, the delay amount application units 328 respectively calculate delayed audio signals that have delays corresponding to the delay amounts, based on the audio signal and the delay amounts, and output the delayed audio signals to the multiplication units 329 respectively corresponding to the delay amount application units 328. As shown in FIG. 9, each delay amount application unit 328 can be formed by using a FIFO buffer 3281 and an all-pass filter 3282, for example.

In S329, each multiplication unit 329 receives the delayed audio signal calculated in S328 and the gain calculated in S327 as inputs, calculates the playback audio signal from the delayed audio signal and the gain, and outputs the playback audio signal to the speaker 130 corresponding to the multiplication unit 329.

Figure 10:
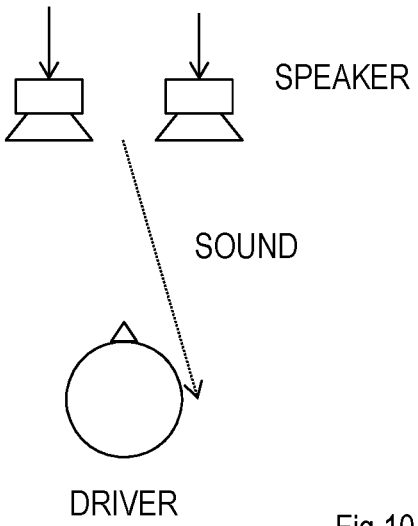
FIG. 10 is a diagram showing an example of a beam forming design.
Figure 11:
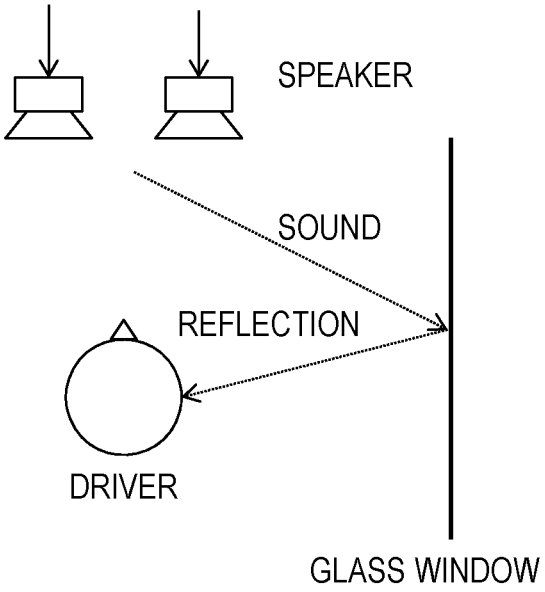
FIG. 11 is a diagram showing an example of a beam forming design.

Note that, as shown in FIG. 10, the audio image forming unit 320 may determine audio image information based on the positional relationship between the speakers and the driver such that the driver perceives the sound emitted from the speakers as a sound coming from the direction indicated by the direction information. As shown in FIG. 11, the audio image forming unit 320 may determine audio image information based on the positional relationship between the speakers, a structural object of a vehicle, and the driver such that the driver perceives the sound emitted from the speakers and reflected by the structural object of the vehicle as a sound coming from the direction indicated by the direction information. In the latter case, beam forming is performed such that the sound will be reflected by the glass window and the driver will hear the sound from the direction of the window, for example. The position of the driver may be, for example, the position of the seat on which the driver sits.

In S130, each speaker 130 specified in the audio image information determined in S320 plays back the playback audio signal specified in the audio image information.

Also in the present embodiment, as in the first embodiment, control of an audio image position may be performed to alert a passenger, or performed to alert both the driver and the passenger. Also, as in the first embodiment, a danger of which the driver and/or the passenger are/is to be notified may be a danger that has occurred in the vehicle.

With the embodiment according to the present invention, a driver can discern the direction in which a danger exists by hearing a sound. By forming a beam according to the direction in which a danger exists and emitting a warning sound, it is possible to localize an audio image in any direction even if speakers are not provided so as to surround the driver, and enable the driver to more precisely discern the direction.

Fourth Embodiment

When a person perceives an audio image, if there is a change in the position of the audio image, it is easy for the person to perceive the position of the audio image. Therefore, the present embodiment describes notification apparatus 101/201/301 that are formed by adding a component for adding fluctuations that change the position of the audio image over time, to the notification apparatus 100/200/300. With such a configuration, it is possible to emphasize the location of the audio image to be perceived by the person.

Figure 12:
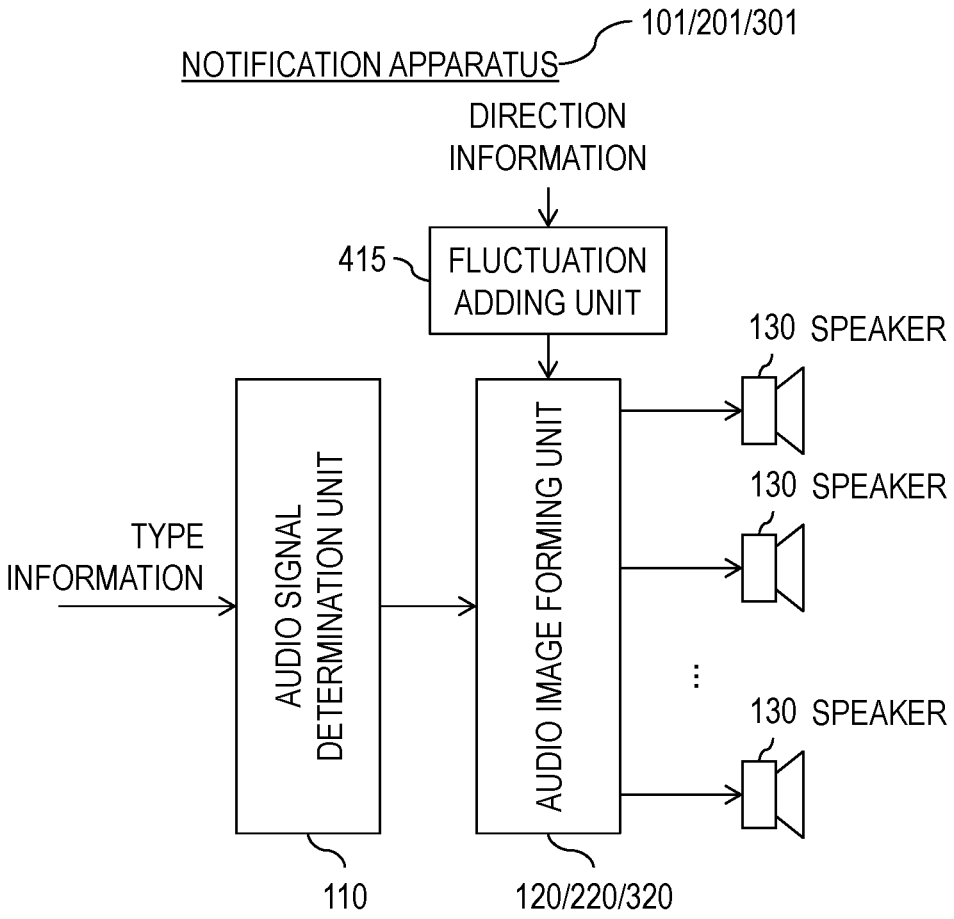
FIG. 12 is a block diagram showing an example of a configuration of a notification apparatus 101/201/301.
Figure 13:
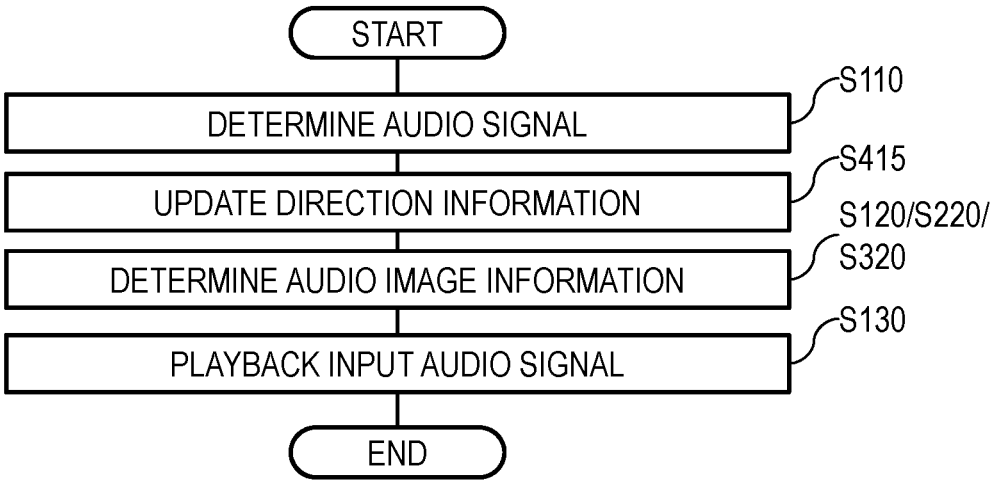
FIG. 13 is a flowchart showing examples of operations of the notification apparatus 101/201/301.
Figure 14:
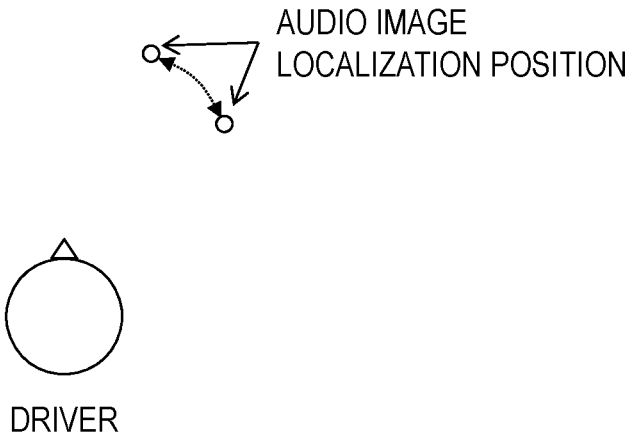
FIG. 14 is a diagram showing fluctuations of an audio image localization position.

The following describes the notification apparatus 101/201/301 with reference to FIGS. 12 and 13. FIG. 12 is a block diagram showing a configuration of the notification apparatus 101/201/301. FIG. 13 is a block diagram showing operations of the notification apparatus 101/201/301. As shown in FIG. 12, the notification apparatus 101/201/301 includes the audio signal determination unit 110, a fluctuation adding unit 415, the audio image forming unit 120/220/320, and the speakers 130. Here, the notification apparatus 101/201/301 includes N speakers 130 (N is an integer equal to or greater than 2). The notification apparatus 101/201/301 is different from the notification apparatus 100/200/300 only in that the fluctuation adding unit 415 is included.

The following describes operations of the notification apparatus 101/201/301 with reference to FIG. 13. Here, only the operations of the fluctuation adding unit 415 will be described.

In step S415, the fluctuation adding unit 415 receives direction information as an input, generates, from the direction information, new direction information by adding directional fluctuations to the direction information, and outputs the new direction information. Here, directional fluctuations are fluctuations that change the direction thereof over time, and the newly generated direction information is direction information in which the direction changes over time. As described above, human beings are sensitive to rapid changes in the position of an audio image in a left-right direction, and such changes improve the perception of the audio image. Therefore, it is desirable that fluctuations are given to the position of the audio image such that the position changes several times per second in a left-right direction. For example, it is preferable that fluctuations of a sine wave of 3 Hz are given so that the position of the audio image changes in a horizontal direction.

With the embodiment according to the present invention, a driver can discern the direction in which a danger exists by hearing a sound. By emitting a warning sound with fluctuations, it is possible to emphasize the location of the audio image to be perceived by the driver, and enable the driver to more precisely discern the direction in which a danger exists.

<Supplementary Notes>

The device according to the present invention, which is, for example, a single hardware entity, includes an input unit to which a keyboard or the like can be connected, an output unit to which a liquid crystal display or the like can be connected, a communication unit to which a communication device (for example, a communication cable) that can communicate with a device outside the hardware entity can be connected, a CPU (Central Processing Unit, which may include a cache memory, a register, and so on), a RAM and a ROM, which are memories, an external storage device, which is a hard disk, and a bus that connects the input unit, the output unit, the communication unit, the CPU, the RAM, the ROM, and the external storage device to each other so that data can be exchanged between them. Also, if necessary, the hardware entity may be provided with a device (drive) or the like that can read out and write data from/to a recording medium such as a CD-ROM. Examples of physical entities that are provided with such a hardware resource include a general-purpose computer.

The external storage device of the hardware entity stores, for example, programs that are required for realizing the above-described functions and data that is required for performing processing on the program (the programs are not necessarily stored in the external storage device, and may be stored in a ROM that is a read-only storage device, for example). Also, data or the like obtained through such processing performed on the programs may be appropriately stored in a RAM or an external device.

In the hardware entity, each program stored in the external storage device (or a ROM or the like) and the data required for processing the program are read into the memory as needed, and are appropriately interpreted, executed, and processed by the CPU. As a result, the CPU realizes predetermined functions (constituent elements described above as units, means, and so on).

As described above, when the processing functions of the hardware entity (a device according to the present invention) described in the above embodiments are realized by using a computer, the details of the processing to be performed by the functions that the hardware entity should have are described using a program. By executing the program on a computer, the processing functions of the above-described hardware entity are realized on the computer.

The program describing the details of processing can be recorded on a computer-readable recording medium. The computer-readable recording medium may be any medium such as a magnetic recording device, an optical disk, an magneto-optical recording medium, a semiconductor memory, or the like, for example. Specifically, for example, a hard disk device, a flexible disk, a magnetic tape, or the like may be used as a magnetic recording device, a DVD (Digital Versatile Disc), a DVD-RAM (Random Access Memory), a CD-ROM (Compact Disc Read Only Memory), a CD-R (Recordable), a CD-RW (ReWritable), or the like may be used as an optical disc, an MO (Magneto-Optical disc) or the like may be used as a magneto-optical recording medium, and an EEPROM (Electronically Erasable and Programmable Read Only Memory) or the like may be used as a semiconductor memory.

In addition, the distribution of this program is carried out by, for example, selling, transferring, or lending a portable recording medium such as a DVD or a CD-ROM on which the program is recorded. Furthermore, it is possible to employ a configuration with which the program is stored in the storage device of a server computer, and the server computer distributes the program by transferring the program to other computers via a network.

For example, a computer that executes such a program first stores a program recorded on a portable recording medium or a program transferred from a server computer in the storage device thereof. Thereafter, when performing processing, the computer reads out the program stored in the storage device thereof, and performs processing according to the program thus readout. Also, in another form of the execution of such a program, the computer may read out the program directly from a portable recording medium and perform processing according to the program. Furthermore, the computer may perform processing according to the received program every time a program is transferred from the server computer to the computer. Also, it is possible to employ a configuration with which the above-described processing is performed using a so-called ASP (Application Service Provider) type service, which realizes processing functions only by using an instruction to execute the program and acquiring the result without transferring the program from the server computer to the computer. Note that a program according to the present embodiment may be information that is to be used by an electronic computational machine to perform processing and is equivalent to a program (for example, data that does not directly provide an instruction to a computer, but has the function of defining processing to be performed by a computer).

Also, although the hardware entity is formed by executing a predetermined program on a computer in this embodiment, at least part of such processing may be realized using hardware.

The above description of the embodiments of the present invention is presented for illustration and description purposes. There is no intention to be exhaustive and no intention to limit the invention to the exact forms disclosed. Modifications and variations can be formed from the above teachings. The embodiments have been chosen and expressed to provide the best illustration of the principles of the present invention, and enable a person skilled in the art to use the present invention in various embodiments that suit well-considered practical use or with various modifications. All such modifications and variations are within the scope of the present invention defined by the appended claims interpreted according to the range that is given fairly, legally, and impartially.

The invention claimed is:

1. A notification apparatus comprising:

processing circuitry configured to: execute an audio signal determination processing that determines, from type information regarding a type of a danger in a vehicle estimated based on sensor data that is data acquired by a sensor, an audio signal corresponding to a type indicated by the type information; an audio image forming processing that determines, from the audio signal and direction information regarding a direction in which the danger in the vehicle has occurred estimated based on the sensor data, one or more persons to be notified, and determines audio image information that are combinations of a speaker that is to emit a sound to prompt a driver the one or more persons to be notified to pay attention to the direction indicated by the direction information and an audio signal that is to be played back by the speaker, by performing beam forming; and speakers that play back an audio signal input thereto, wherein the audio image information is determined based on a positional relationship between the speakers, a structural object of a vehicle, and the one or more persons to be notified so that the one or more persons to be notified perceives a sound emitted from the speakers and reflected by the structural object of the vehicle as a sound coming from the direction indicated by the direction information.

2. The notification apparatus according to claim 1, further comprising: a fluctuation adding processing that generates, from the direction information, new direction information by adding directional fluctuations to the direction information.

3. A notification apparatus comprising:

processing circuitry configured to: execute an audio signal determination processing that determines, from type information regarding a type of a danger in a vehicle estimated based on sensor data that is data acquired by a sensor, an audio signal corresponding to a type indicated by the type information; a fluctuation adding processing that generates, from direction information regarding a direction in which the danger in the vehicle has occurred estimated based on the sensor data, new direction information by adding directional fluctuations to the direction information; an audio image forming processing that determines, from the audio signal and the direction information, one or more persons to be notified, and determines audio image information that are combinations of a speaker that is to emit a sound to prompt the one or more persons to be notified to pay attention to the direction indicated by the direction information and an audio signal that is to be played back by the speaker, by performing beam forming; and speakers that play back an audio signal input thereto, wherein the audio image information is determined based on a positional relationship between the speakers and the one or more persons to be notified so that the one or more persons to be notified perceives a sound emitted from the speakers as a sound coming from the direction indicated by the direction information.

4. A notification apparatus comprising:

processing circuitry configured to: execute an audio signal determination processing that determines, from type information regarding a type of a danger in a vehicle estimated based on sensor data that is data acquired by a sensor, an audio signal corresponding to a type indicated by the type information; a fluctuation adding processing that generates, from direction information regarding a direction in which the danger in the vehicle has occurred estimated based on the sensor data, new direction information by adding directional fluctuations to the direction information; an audio image forming processing that determines, from the audio signal and the direction information, one or more persons to be notified, and determines audio image information that are combinations of a speaker that is to emit a sound to prompt the one or more persons to be notified to pay attention to the direction indicated by the direction information and an audio signal that is to be played back by the speaker, by performing pan control; and speakers that play back an audio signal input thereto.

5. A notification method comprising: an audio signal determination step in which a notification apparatus determines, from type information regarding a type of a danger in a vehicle estimated based on sensor data that is data acquired by a sensor, an audio signal corresponding to a type indicated by the type information; an audio image forming step in which the notification apparatus determines, from the audio signal and direction information regarding a direction in which the danger in the vehicle has occurred estimated based on the sensor data, one or more persons to be notified, and determines audio image information that are combinations of a speaker that is to emit a sound to prompt a driver the one or more persons to be notified to pay attention to the direction indicated by the direction information and an audio signal that is to be played back by the speaker, by performing beam forming; and a playback step in which speakers included in the notification apparatus plays back an audio signal input thereto, wherein the audio image information is determined based on a positional relationship between the speaker, a structural object of a vehicle, and the one or more persons to be notified so that the one or more persons to be notified perceives a sound emitted from the speaker and reflected by the structural object of the vehicle as a sound coming from the direction indicated by the direction information.

6. A notification method comprising: an audio signal determination step in which a notification apparatus determines, from type information regarding a type of a danger in a vehicle estimated based on sensor data that is data acquired by a sensor, an audio signal corresponding to a type indicated by the type information; a fluctuation adding step in which the notification apparatus generates, from direction information regarding a direction in which the danger in the vehicle has occurred estimated based on the sensor data, new direction information by adding directional fluctuations to the direction information; an audio image forming step in which the notification apparatus determines, from the audio signal and the direction information, one or more persons to be notified, and determines audio image information that are combinations of a speaker that is to emit a sound to prompt the one or more persons to be notified to pay attention to the direction indicated by the direction information and an audio signal that is to be played back by the speaker, by performing beam forming; and a playback step in which speakers included in the notification apparatus plays back an audio signal input thereto, wherein the audio image information is determined based on a positional relationship between the speaker and the one or more persons to be notified so that the one or more persons to be notified perceives a sound emitted from the speaker as a sound coming from the direction indicated by the direction information.

7. A notification method comprising: an audio signal determination step in which a notification apparatus determines, from type information regarding a type of a danger in a vehicle estimated based on sensor data that is data acquired by a sensor, an audio signal corresponding to a type indicated by the type information; a fluctuation adding step in which the notification apparatus generates, from direction information regarding a direction in which the danger in the vehicle has occurred estimated based on the sensor data, new direction information by adding directional fluctuations to the direction information; an audio image forming step in which the notification apparatus determines, from the audio signal and the direction information, one or more persons to be notified, and determines audio image information that are combinations of a speaker that is to emit a sound to prompt the one or more persons to be notified to pay attention to the direction indicated by the direction information and an audio signal that is to be played back by the speaker, by performing pan control; and a playback step in which speakers included in the notification apparatus plays back an audio signal input thereto.

8. A non-transitory computer-readable storage medium which stores a program for causing a computer to function as the notification apparatus according to any one of claims 1 to 4.

* * * * *